United States Patent [19]

Matsumoto

[11] 3,951,653

[45] Apr. 20, 1976

[54] METHOD OF PREVENTING TONER BUILD-UP ON ELECTRODES DURING LIQUID DEVELOPMENT

[75] Inventor: Seiji Matsumoto, Tokyo, Japan

[73] Assignee: Rank Xerox Ltd., London, England

[22] Filed: Aug. 30, 1973

[21] Appl. No.: 393,095

[52] U.S. Cl. ..... 96/1 PE; 96/1 LY

[51] Int. Cl.[2] ..... G03G 13/22

[58] Field of Search ..... 96/1 LY, 1 SD, 1 PE; 117/37 LE; 355/10

[56] References Cited

UNITED STATES PATENTS

| | | | |
|---|---|---|---|
| 3,560,203 | 2/1971 | Honjo et al. | 96/1 LY |
| 3,707,943 | 1/1973 | Matsumoto et al. | 117/37 LE |
| 3,783,827 | 1/1974 | Fukushima et al. | 117/37 LE |

FOREIGN PATENTS OR APPLICATIONS

| | | | |
|---|---|---|---|
| 1,214,155 | 12/1970 | United Kingdom | 96/1 LY |

*Primary Examiner*—David Klein
*Assistant Examiner*—Judson R. Hightower
*Attorney, Agent, or Firm*—James J. Ralabate; James P. O'Sullivan; John H. Faro

[57] ABSTRACT

An improved electrophoretic development method comprising providing a liquid developer system having a backing electrode and a developer electrode, wherein the development electrode comprises a plurality of individually biased electrodes. According to this improved method, as an electrostatically imaged insulating member is contacted with the liquid developer and directed through a development zone defined by said electrodes, the leading edge of said insulating member selectively activates the individually biased development electrodes in synchronization with the travel of the insulating member through said zone, and the trailing edge of said insulating member selectively inactivates the individually biased development electrodes upon the withdrawal of the insulating member from said zone. This method is especially suitable for preparation of reversal images by electrophoretic development.

7 Claims, 5 Drawing Figures

METHOD OF PREVENTING TONER BUILD-UP ON ELECTRODES DURING LIQUID DEVELOPMENT

BACKGROUND OF THE INVENTION

1. Field of the Invention

This invention relates to a method, an apparatus and a process. More specifically, this invention concerns a method for synchronization of the biasing potential between a plurality of development electrodes and a backing electrode with the successive travel of an electrostatically imaged discontinuous insulting sheet.

2. Description of the Prior Art

The formation and development of images on the imaging surfaces of photoconductive materials by electrostatic means is well-known. The best known of the commercial processes, more commonly known as xerography, involves forming a latent electrostatic image on the imaging surface of an imaging member by first uniformly electrostatically charging the surface of the imaging member in the dark and then exposing this electrostatically charged surface to a light and shadow image. The light struck areas of the imaging layer are thus rendered conductive and the electrostatic charge selectively dissipated in these irradiated areas. After the photoconductor is exposed, the latent electrostatic image on the this image bearing surface is rendered visible by development with finely divided colored electroscopic materials, known in the art as "toner". Depending upon the relative polarity of the charge of the toner and the latent electrostatic image, the toner can be attracted or repelled by said image. In the event that the toner is of an opposite polarity to the latent image, it will be attracted thereto and thus form a positive reproduction of the original. Alternatively, in the event that the toner and the latent image are of similar polarity, the toner will be repelled by the charge pattern and attracted to the nonimaged or background areas thus forming what is commonly referred to as a reversal image.

The developed image can be read or permanently affixed to the photoconductor where the imaging layer is not to be reused. This latter practice is usually followed with respect to the binder-type photoconductive films (e.g. zinc oxide in a film forming insulating resin) where the photoconductive imaging layer is also an integral part of the finished copy.

In so-called "plain paper" copying systems, the latent image can be developed on the imaging surface of a reusable photoconductor or transferred to an insulating member, such as a sheet of paper and thereafter developed. Where the latent image is transferred to an insulating member it can be rendered visible by development with either dry or liquid developers. In liquid development systems, (also hereinafter referred to as electrophoretic development systems) charged developer materials dispersed in an insulating liquid are brought in contact with the latent image by the establishment of a biasing potential across the liquid whereby the charged developer materials move under the influence of a unidirectional field toward the latent image bearing surface of the insulating sheet. Where the developer materials and the latent image are of different polarities, the developer is readily attracted and attached thereto. Alternatively, where the developer and the latent image are of the same polarity, the relative electrostatic forces result in repulsion of said particles. These particles thus attach only to those areas on the insulating sheet having little or no charge density. In this latter situation, the retention of developer particles is not assisted by any forces present on the insulator but rather is principally dependant upon the magnitude of the impelling electrical force in the developer liquid for their adherence to this surface.

In reversal development, developer particles are generally attracted only to those areas where there is little, if any, charge density, thus, producing very poor continuous tone reversal images. In order to improve the continuous tone quality of such reversal images, the DC voltage applied to the development electrode should preferably be equal to the surface potential of the area of maximum charge density of the latent electrostatic image. This will provide an electric field between the development electrode and the insulating layer in proportion to the difference between the maximum charge density and the charge density of the less highly charged areas.

The above arrangement provides satisfactory development of reversal images having good continuous toner quality. In carrying out the above development process, it has been common practice to use a continuous insulating sheet. This provides a barrier to deposition of developer materials on the backing electrode during the maintenance of an electrical bias between the development and backing electrodes. In the event, that cut sheets (hereinafter referred to as discontinuous insulating members) are used, the electrostatically imaged insulating member would first have to be placed between the two electrodes and the apparatus thereafter activated. Upon completion of development of the latent image on the insulating member, the apparatus would then have to be inactivated and the developed insulator removed. This type of sequence is not practical where the only force maintaining the developer particles on the surface of the insulating member is the field created by the electrical bias between the two electrodes. Upon removal of said bias, at least some developer particles will diffuse from the surface of the insulating member thus partially destroying the visible image pattern thereon. In order to prevent this from occurring, the electrical bias must be maintained during and subsequent to removal of the insulating member from the development zone intermedite between these electrodes. Where such member is in the form of a discontinuous sheet, its gradual withdrawal from said zone under such conditions will permit the deposition of developer particles on the backing electrode in those areas where said insulator no longer separates the two electrodes. This deposition of developer particles on the backing electrode is not only wasteful of such developer materials but also interferes with the establishment of an electrical bias between said electrodes in the development of successive latent electrostatic images.

It is, therefore, the object of this invention to provide a method for the electrophoretic development of reversal images on discontinuous insulators devoid of the above noted deficiencies.

More specifically, it is the object of this invention to provide an electrophoretic development method wherein developer materials are selectively attracted to an electrostatically imaged discontinuous insulating member during its passage through and withdrawal from the developer liquid.

It is a further object of this invention to provide an apparatus suitable for use in the above method.

SUMMARY OF THE INVENTION

The above and related objects are achieved by providing an electrophoretic development method which employs a liquid development system having a backing electrode and a development electrode, wherein the development electrode comprises a plurality of individually biased electrodes. According to this improved method, as an electrostatically imaged discontinuous insulating member is contacted with the developer material and directed through a development zone defined by the backing electrode and the development electrode, the leading edge of said insulating member sequentially activates the various segments of the individually biased development electrodes in synchronization with the travel of the insulating member through said development zone and the trailing edge of said insulating member sequentially inactivates the various segments of the individually biased development electrodes upon the withdrawal of the insulating member from said development zone. In the preferred embodiments of this invention, insulating spacers are arranged laterally between adjacent segments of the development electrode. In yet another preferred embodiment of this invention, a bias voltage gradient is established so as to provide a greater electrical bias at the inlet end of the development zone than at the outlet end.

DESCRIPTION OF THE INVENTION INCLUDING PREFERRED EMBODIMENTS

According to the method of this invention an electrophoretic development system is provided which is capable of development of electrostatically imaged discontinuous insulating members and yet minimizes the consumption of developer materials as a result of unwanted deposition on the mechanical/electrical elements of the development apparatus. This method is especially suitable for electrophoretic development of reversal images.

Figure 1:
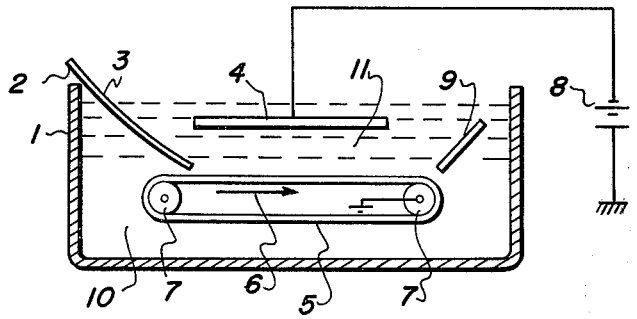
FIG. 1 is a schematic side sectional view of the ordinary reversal liquid device for electrophotography.

Preliminary to further discussion of this method, it is desirable to initially review operation of a conventional electrophoretic development system and the problems associated with its use in combination with electrostatically imaged discontinuous insulating members. In FIG. 1 is shown such a system wherein reservoir 1 is filled with liquid developer 10. This liquid developer comprises charged toner materials dispersed in an insulating liquid. Initially, a latent electrostatic image 3 is formed on insulating sheet 2. This electrostatically imaged sheet is then immersed in the developer liquid and transported by belt 5 (hereinbefore and hereinafter referred to as the backing electrode) in the direction indicated by the arrow through development zone 11. This zone is defined as the gap between belt 5 and development electrode 4. Upon the introduction of the leading edge of the insulating sheet into the development zone, a biasing potential is established between the development electrode and the backing electrode by DC power source 8. As the electrostatically imaged sheet passes through this development zone, charged developer materials are impelled toward the electrostatically charged surface of said insulating sheet under the influence of the field established as a result of the biasing potential between development electrode 4 and backing electrode 5. As the leading edge of the electrostatically imaged insulating sheet exits the developer zone, it is directed by guide panel 9 out of the liquid developer. The magnitude of the field required to impell the charged developer particles to the electrostatically charged surface of the insulating sheet is considerably, and upon the removal of said sheet from the development zone substantial quantities of developer are deposited upon the backing electrode. Any attempt to remove the electrical bias between these electrodes subsequent to the passage of said sheet from the development zone but prior to its removal from the developer liquid will result in a partial diffusion of said developer particles from said sheet, especially where the developer particles are solely dependant upon the impelling force of the electrical field within the developer liquid for their attachment to the insulating sheet.

Figure 2:
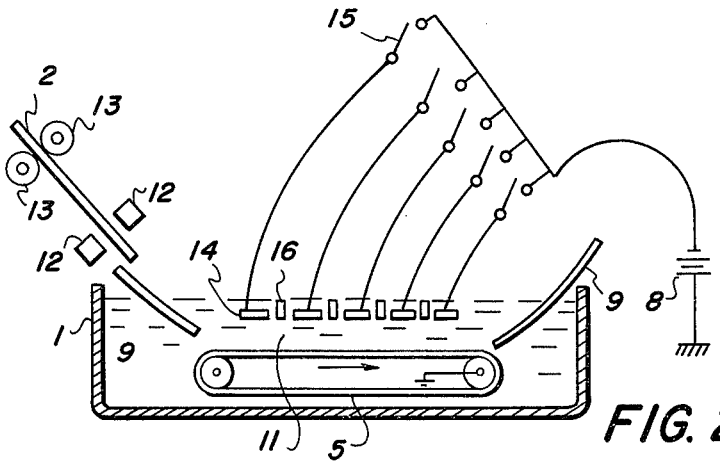
FIG. 2, FIG. 3, FIG. 4, and FIG. 5 are schematic diagrams illustrating various embodiments of the liquid developing device of the present invention.

The apparatus useful in the method of this invention, as shown in FIG. 2, comprises a number of the same components which are present in FIG. 1. The principal differences being that the development electrode 14 comprises a plurality of individually biased electrodes which in response to information provided by sensors 12 and 12', are successively biased, after an initial lag period, in synchronization with the travel of said electrostatically imaged insulating member through development zone 11. The interruption of the beam between said sensors, activates a synchronization mechanism (now shown) which communicates the relative position of the leading edge relative to the inlet region development zone. As the leading edge of the electrostatically imaged insulating member enters the inlet end of development zone 11, the initial segment of development electrode 14 is biased by the closure of switch 15. This successive biasing of the various segments of development electrode 14 proceeds sequentially in correspondence with the movement of the insulating sheet through the development zone. As the trailing edge of the electrostatically imaged insulating member passes between sensors 12 and 12', this information is relayed to the various control switches which have been previously engaged. After a predetermined interval, these same switches are successively opened thereby severing the connection between the power source and the various segments of the development electrode. Such disengagement of these switches is coordinated with the movement of the trailing edge of the insulating member through the development zone. Since the various segments of the development electrode can be individually biased, it is possible to create a situation wherein there will be a difference in potential between adjacent segments of said electrode. This difference in potential can cause the deposition of developer materials on the various segments of this electrode. In order to prevent such an occurence, insulating spacers 16 are arranged laterally between adjacent segments of the development electrode. These spacers provide a shield between such segments and thereby prevent deposition of developer materials thereon even where a difference in potential exists between adjacent segments of the development electrode. It is advisable that such spacers be constructed of a materials whose specific resistance is in excess of about $10^{15}$ ohm - centimeters. Typical of materials which are suitable for this purpose include the insulating resin traditionally used as binders in preparation of electrophotographic imaging members.

Figure 3:
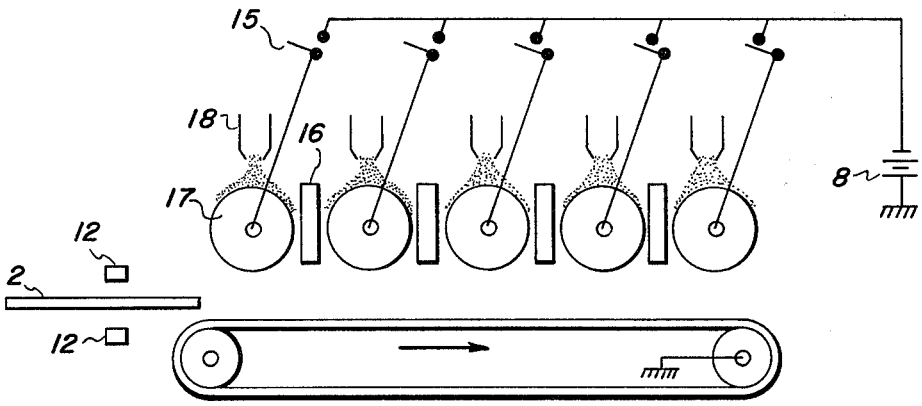

FIG. 3 represents an alternative embodiment of this invention wherein the development electrode comprises a plurality of small diameter rollers 17. These rollers are mechanically driven by a power source (not shown) and thereby facilitate uniform distribution of developer materials within zone 11 in addition to assisting in the transport of the electrostatically imaged insulating sheet through said zone. The developer materials are supplied by nozzles 18 arranged above the rollers. Even though the developer materials flow over these rollers prior to deposition on the insulating sheet, the developer materials do not coat the rollers and thus contact of the insulating sheet with said rollers does not result in smearing of the developer materials. The dispensing of developer materials on the insulating member is also synchronized with the travel of the insulating member.

Figure 4:
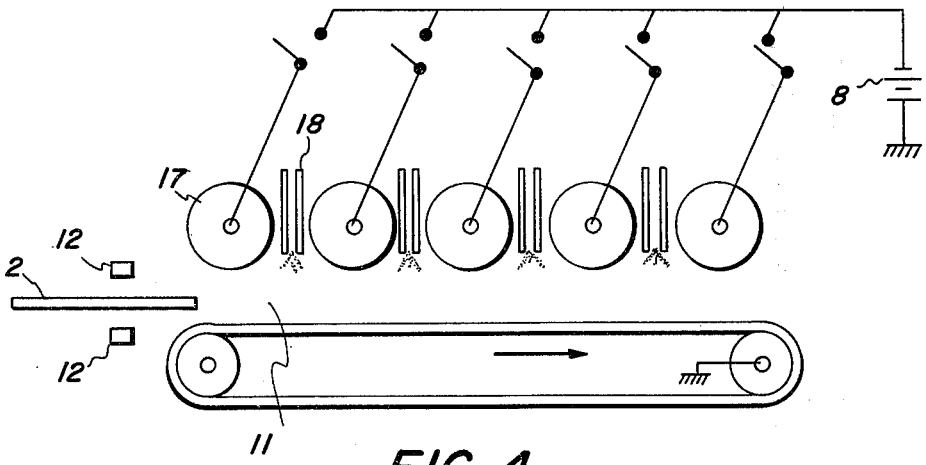

In FIG. 4 is shown a modification of the apparatus illustrated in FIG. 3. In this embodiment of the invention, the developer dispensing nozzles 18 also serve as insulators between adjacent segments of the development electrode.

Figure 5:
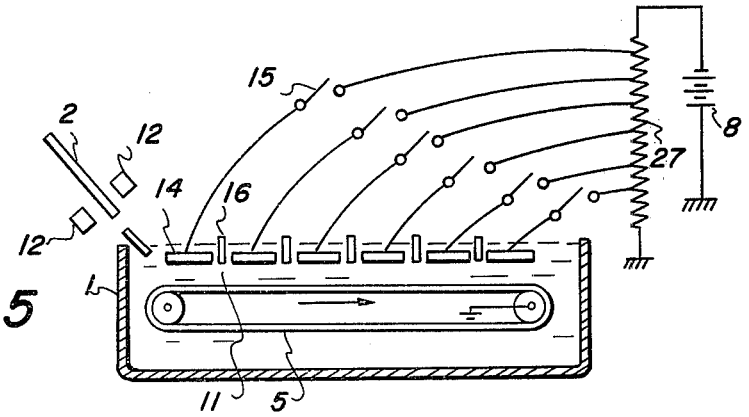

FIG. 5 is illustrative of one of the preferred embodiments of this invention wherein the individual segments of the development electrode are biased at different potentials. It is well-known that in order to minimize dark attenuation of a latent electrostatic image on an insulating member it is desirable to apply a higher biasing voltage upon initial introduction of the insulating member into the development zone. This is achieved in this apparatus by placing a greater bias across the segment of the development electrode at the inlet end of the development zone and thereafter gradually decresing said bias with each successive segment of the development electrode. This type of gradient is achieved in the apparatus shown in FIG. 5 by connecting the various segments of the development electrode to a series of resistors 27 wherein the impedance of said resistors is directly proportional to the relative position of the individually biased segments of the development electrode.

Although the aforedescribed method is particularly suitable for use in electrophoretic development of reversal images, this same method can also be used to advantage in the development of positive images on discontinuous imaging members.

What is claimed is:

1. An improved electrophoretic development method, comprising:

a. providing a liquid development system having (1) a development zone defined by a backing electrode and a development electrode, said development electrode comprising a plurality of individually biased electrodes, each individually biased electrode being separated from the adjacent individually biased electrode by an insulating spacer, and (2) means for transporting an electrostatically imaged discontinuous insulating sheet through said zone; and b. passing an electrostatically imaged discontinuous insulating sheet in contact with the liquid developer through said development zone concurrent with sequential activation of the individually biased development electrodes in synchronization with the travel of the leading edge of said insulating member and sequential inactivation of the individually biased development electrodes in synchronization with the travel of the trailing edge of said insulating member.

2. The method of claim 1, wherein the bias potential between the backing electrode and the development electrode is approximately equivalent to the surface potential of the area of the latent image of maximum charge density.

3. The method of claim 1, wherein a bias voltage gradient is established along said development electrode, the bias potential of greatest magnitude being maintained between the individually biased segment of the development electrode and the backing electrode located at the inlet end of the development zone with a progressive decrease in bias potential in each successive segment of the development electrode toward the outlet end of the development zone.

4. The method of claim 1, wherein the development electrode comprises a plurality of rollers.

5. The method of claim 1, wherein the liquid developer is dispensed in synchronization with the travel of the discontinuous insulating member through the development zone.

6. The method of claim 1, wherein the relative polarity of the latent image and the developer materials results in the attraction of said materials to said image upon the passage of the electrostatically imaged discontinuous insulating member through the development zone.

7. The method of claim 1, wherein the relative polarity of the latent image and the developer materials results in the repulsion of said materials from said image upon the passage of the electrostatically imaged discontinuous insulating member through the development zone.

* * * * *